US006402132B1

(12) United States Patent
Michaelis et al.

(10) Patent No.: US 6,402,132 B1
(45) Date of Patent: Jun. 11, 2002

(54) METHOD OF FOLDING DEMAND-PRINTED WEBS INTO SIGNATURES FOR GATHERING IN ROTARY GATHERING/ BINDING MACHINES AND SIGNATURES PRODUCED THEREBY

(75) Inventors: A. John Michaelis, Glen Ellyn; Stephen M. Purduski, Naperville; James L. Warmus, LaGrange, all of IL (US)

(73) Assignee: R. R. Donnelley & Sons, Downers Grove, IL (US)

( * ) Notice: Subject to any disclaimer, the term of this patent is extended or adjusted under 35 U.S.C. 154(b) by 0 days.

(21) Appl. No.: 09/642,754

(22) Filed: Aug. 21, 2000

(51) Int. Cl.[7] ..... B41F 13/54

(52) U.S. Cl. ..... 270/1.01; 270/39.05; 270/40; 270/21.1; 101/227; 156/277; 400/621.1; 281/21.1

(58) Field of Search ..... 270/1.01, 5.01, 270/12, 21.1, 20.1, 39.05, 40; 283/5, 105; 281/2, 21.1; 462/2, 4, 6; 493/358, 410, 412; 229/92.1, 92.8; 400/621.1, 621.2; 101/226, 227; 156/204, 277

(56) References Cited

U.S. PATENT DOCUMENTS

| | | | | | |
|---|---|---|---|---|---|
| 2,181,117 | A | | 11/1939 | Brenn | |
| 2,272,803 | A | * | 2/1942 | Horner | 270/40 |
| 2,699,936 | A | | 1/1955 | Dixon et al. | |
| 3,052,464 | A | | 9/1962 | Funk | |
| 3,899,381 | A | * | 8/1975 | O'Brien | 156/277 |
| 3,955,750 | A | * | 5/1976 | Huffman | 229/92.1 |
| 3,966,185 | A | | 6/1976 | McCain et al. | |
| 3,977,665 | A | | 8/1976 | Bowman et al. | |
| 3,982,744 | A | * | 9/1976 | Kraynak et al. | 270/12 |
| 4,054,283 | A | | 10/1977 | Rayfield | |
| 4,063,398 | A | | 12/1977 | Huffman | |
| 4,076,231 | A | | 2/1978 | Kutzner et al. | |
| 4,279,409 | A | * | 7/1981 | Pemberton | 270/32 |
| 4,310,326 | A | | 1/1982 | Bellanca | |
| 4,408,755 | A | * | 10/1983 | Meier | 270/52.01 |
| 4,824,503 | A | * | 4/1989 | Wilen | 270/20.1 |
| 4,900,001 | A | * | 2/1990 | Lapeyre | 270/1.01 |
| 5,015,137 | A | * | 5/1991 | Stenner | 281/5 |
| 5,030,193 | A | | 7/1991 | Breton et al. | |
| 5,054,757 | A | | 10/1991 | Martin et al. | |
| 5,065,992 | A | | 11/1991 | Crowley | |
| 5,197,922 | A | * | 3/1993 | Schubert | 281/2 |
| 5,242,326 | A | * | 9/1993 | Dexter | 462/2 |
| 5,279,536 | A | * | 1/1994 | Abreu | 493/410 |
| 5,300,007 | A | | 4/1994 | Kober | |
| 5,348,277 | A | * | 9/1994 | Crowley | 270/39.05 |
| 5,376,048 | A | * | 12/1994 | Whiteside | 462/6 |
| 5,377,965 | A | | 1/1995 | Mandel et al. | |
| 5,405,127 | A | * | 4/1995 | Welborn | 270/21.1 |
| 5,776,591 | A | * | 7/1998 | Mertens | 283/105 |
| 5,782,691 | A | * | 7/1998 | Stewart | 462/4 |
| 5,891,007 | A | * | 4/1999 | Bay | 493/358 |
| 5,941,451 | A | * | 8/1999 | Dexter | 229/92.1 |
| 6,010,122 | A | | 1/2000 | Weber | |
| 6,027,780 | A | * | 2/2000 | Treleaven et al. | 281/2 |
| 6,053,855 | A | * | 4/2000 | Stenner | 229/92.8 |
| 6,284,083 | B1 | * | 9/2001 | Dahlquist | 156/204 |

FOREIGN PATENT DOCUMENTS

| | | | |
|---|---|---|---|
| DE | 3125369 | A | * 5/1982 |
| GB | 2100189 | A | * 12/1982 |

* cited by examiner

*Primary Examiner*—Eugene Eickholt
(74) *Attorney, Agent, or Firm*—Marshall, Gerstein & Borun

(57) ABSTRACT

A method for folding demand printed webs into signatures for gathering by rotary gathering and binding machines, as well as the signatures produced thereby, are disclosed. The method involves the steps of digitally printing pages onto a moving web of material, creating a series of fan folds across the transverse axis of the web, severing the web after a desired number of fan folds have been created to form a separate log, and chop folding the resulting log zero one or more times to form a signature. The resulting signature includes a plurality of layers each having pages printed thereon in proper orientation and sequence and includes a sturdy closed backbone which enables the signature to be easily handled by conventional high-speed rotary gathering machines.

27 Claims, 2 Drawing Sheets

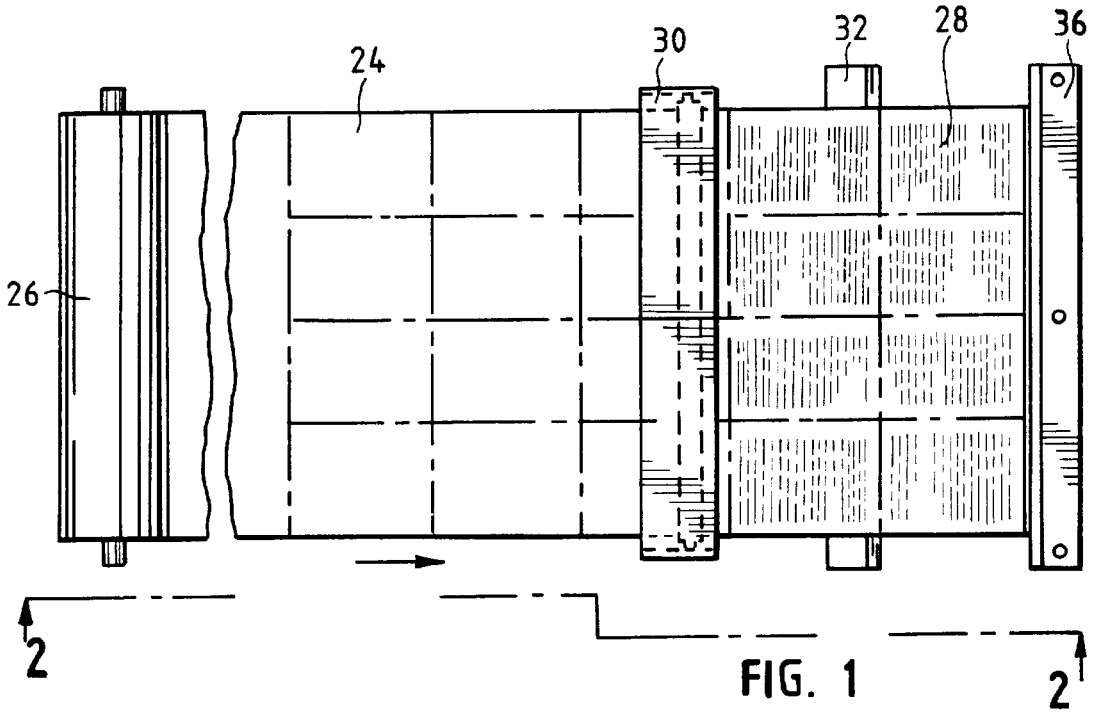
FIG. 1
FIG. 2
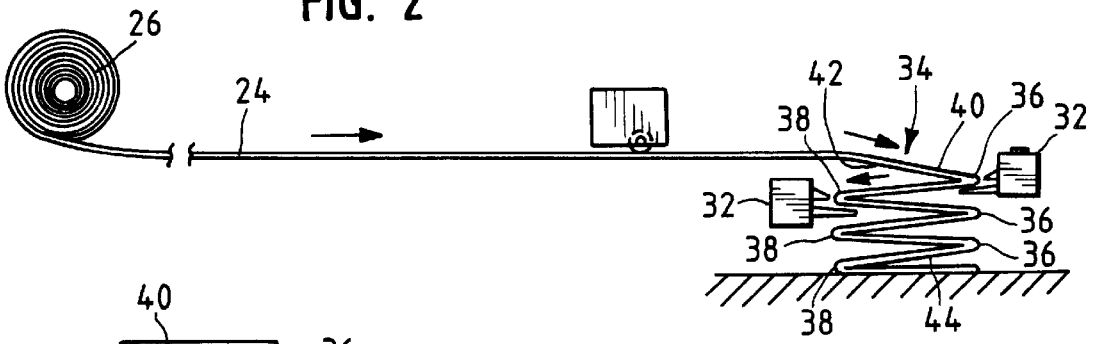
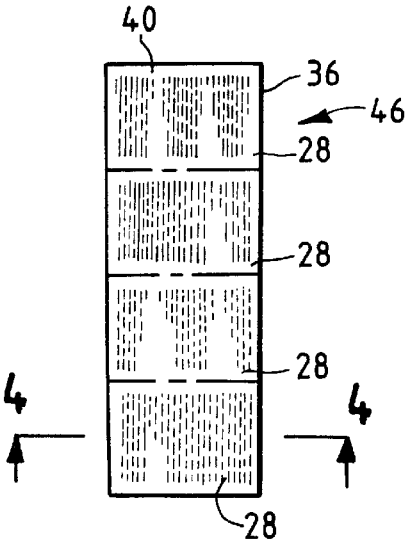
FIG. 3
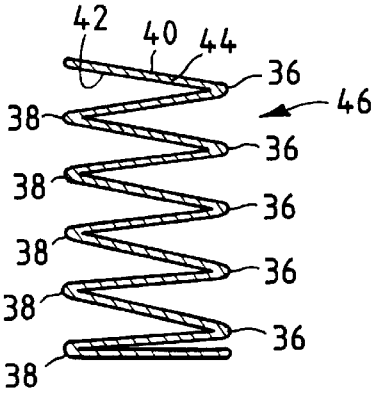
FIG. 4

METHOD OF FOLDING DEMAND-PRINTED WEBS INTO SIGNATURES FOR GATHERING IN ROTARY GATHERING/ BINDING MACHINES AND SIGNATURES PRODUCED THEREBY

FIELD OF THE INVENTION

The invention generally relates to signatures of the type adapted to be bound into a publication, and more particularly relates to methods of producing such signatures.

BACKGROUND OF THE INVENTION

In the production of many printed publications, such as books, magazines and the like, signatures are typically created from a moving web of printable material. More specifically, the web is printed, meaning a number of pages are printed across and along the web, with a series of folds then being made in the web to create a multi-layered signature. The web is then cut to release the signature. The edges of the signature are then severed to create individual pages which can be bound together, or which can be combined with one or more signatures to create a larger volume publication.

Conventionally, pages have been printed upon moving webs in a sequential order. However, with the advent of digital printing and print-on-demand machines, the pages of a publication can be formatted and manipulated using a computer screen or other operator interface device prior to actually printing images on the web. Among other things, this allows the operator to select the pages of interest regardless of sequence, and also allows the selected pages to be oriented for proper layout and position when printed onto the web and ultimately folded into a signature.

In addition to being flexible and efficient, it is important that the method by which such signatures are manufactured results in signatures of a sturdy construction which are mechanically compatible with high-speed rotary gathering machines currently used in production of books, magazines, catalogs, directories, etc. A stable signature enables such a high-speed rotary gathering machine to extract a single signature from a stack and place it onto a gathering belt for binding or subsequent combination with other signatures prior to binding.

SUMMARY OF THE INVENTION

In accordance with one aspect of the invention, a method of producing a signature is provided which comprises the steps of printing pages onto a moving web, creating multiple fan folds across the web, cutting the web after a desired number of fan folds have been created, and creating at least one chop fold. The web moves along a longitudinal axis with each fan fold being made along a transverse axis of the web, the transverse axis being orthogonal to the longitudinal axis. The cutting step results in a log having a zig-zag configuration in transverse cross-section. Each chop fold is made along the longitudinal axis of the web.

In accordance with another aspect of the invention, a method of producing a bound publication is provided which comprises the steps of traversing a web of printable material along a longitudinal axis, printing pages onto the moving web, fan folding the web transverse to the longitudinal axis, cutting the web transverse to the longitudinal axis resulting in a separated log, chop folding the log along the longitudinal axis to form a signature, shearing edges of the signature to create individual pages, and binding the individual pages together.

In accordance with another aspect of the invention, a signature formed from a moving web of material is provided which comprises a continuous sheet of printable material, at least one fold in the continuous sheet along a transverse axis of the signature, at least one fold in the continuous sheet along a longitudinal axis of the signature and a closed backbone along a first edge of the signature. The moving web has pages printed thereon by a print-on-demand device. The signature is adapted to be gathered and bound by a rotary gathering and binding machine. The continuous sheet has multiple layers wherein each layer has pages printed thereon. The fold along the longitudinal axis creates a fold in the fold made along the transverse axis. The closed backbone is formed by the fold along the longitudinal axis.

These and other features and aspects of the invention will become more apparent from the following detailed description when taken in conjunction with the accompanying drawings.

BRIEF DESCRIPTION OF THE DRAWINGS

FIG. 1 is a schematic representation of a web being printed and fan folded according to the teachings of the invention;

FIG. 2 is a side view of FIG. 1 taken along line 2—2 of FIG. 1;

FIG. 3 is a schematic representation of a fan folded bundle cut from a moving web according to the teachings of the invention;

FIG. 4 is a side view of FIG. 3 taken along line 4—4 of FIG. 3;

Figure 5:
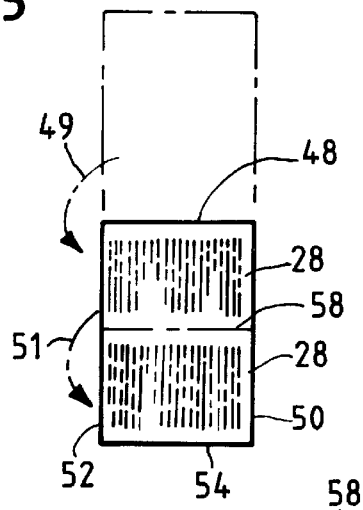
FIG. 5 is a schematic representation of the bundle of FIG. 3 after a first chop fold.

While the invention is susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling with the spirit and scope of the invention as defined by the appended claims.

DETAILED DESCRIPTION OF THE PREFERRED EMBODIMENTS

Figure 6:
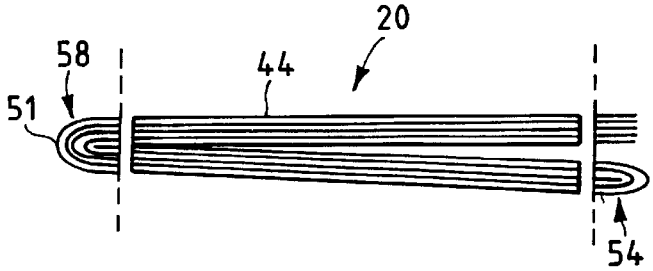
FIG. 6 is an end view of a signature formed by chop folding the bundle of FIG. 5.

Referring now to the drawings, and with specific reference to FIGS. 5 and 6, a signature manufactured according to the teachings of the present invention is generally depicted by reference numeral 20. While the signature 20 depicted includes a certain number of layers, and is of a certain dimensional proportion, it is to be understood that the teachings of the invention can be employed in manufacturing signatures of a different number of layers, shapes or sizes.

As illustrated in FIGS. 1 and 2, the signature 20 is formed from a moving web 24 of printable material, such as paper. The web 24 is typically provided in the form of a wound roll 26 which is unwound by suitable motorized rollers (not shown) into a planar surface upon which pages 28 can be printed via a printer 30. Typically, the web 24 is provided in a nominal size of approximately 18" in width (as measured across a transverse axis A), which thereby enables 2, 3 or more pages 28 to be printed across the web 24.

According to the teachings of the invention, the printer 30 is preferably provided in the form of a print-on-demand or digital type of printer such as a laser-jet printer, ink-jet printer, or the like. The printer 30 is of the type providing operator interface enabling a user to format and orient the pages 28 on a computer screen prior to actual printing upon the web 24. Among other things, such capability facilitates proper layout of the pages 24 when stacked into the signature 20, and efficiently utilizes all printable space provided on the web 24.

In addition, the printer 30 and teachings of the invention enable the operator to customize the resulting signature 20. For example, different versions of the same basic signature 20 can be created for the purpose of a marketing test, such as an A-B market split test. In other words, if the signature 20 being manufactured is for a periodical or advertisement, first and second, or more, versions of the signature can be manufactured, with a predetermined percent, such as fifty, being of one type and being forwarded to one group of subscribers, and the remainder being of the other type and being forwarded to another subscriber. The versions could differ in many ways, including but not limited to, content, page count, and the like. Each version could be printed with a specific code for tracking and analysis purposes.

Such customization capability also allows each signature 20 to be printed with the address of a given subscriber to facilitate mail delivery. In addition to different addresses, each signature 20 could be tailored in content to match the likes, dislikes, buying trends, etc., of the particular addressee. The signature 20 could be used as a self-addressed cover piece, or could be combined with another signature of generic or specialized content. In such a latter embodiment, synchronization mechanisms such as bar codes, optically readable marks and the like, may be used to match one of the self-addressed signatures with a non-addressed signature.

Referring now to FIG. 1, the roll 26 is unwound in the direction of a longitudinal axis B to form the planar web 24 upon which pages 28 are printed by the printing device 30. Downstream of the printing device 30, a folding mechanism 32 is provided to enable a series of fan folds 34 to be made across the web 24, or in other words, along the transverse axis A of the web 24. As used herein, the term "fan folds" is defined as a series of folds made into a sheet of material in alternating directions, e.g., those of a bellows, or accordion, resulting in a zig-zag configuration in transverse cross-section. As shown in FIG. 2, the fan folds 34 alternate from a head fold 36 to a foot fold 38 back to a head fold 36 and so on. Conventionally, pages 28 will be printed on both sides of the web 24 such that upon creation of the fan folds 34, the pages 28 would be provided on upper and lower surfaces 40, 42 of each layer 44.

Once a desired number of fan folds 34 have been created, the web 24 is severed to result in a separated log 46, as depicted in FIGS. 3 and 4. Depending upon the size and orientation of the pages 28 and log 46, zero, one or more chop folds 48 can be made into the resulting log 46 to form the signature 20. Each chop fold 48 is made in a direction parallel to the longitudinal axis B of the web 24. As shown in FIG. 5 a first chop fold 48 (indicated by arrow 49) can be made, and then as shown in FIG. 6, a second chop fold 48 (indicated by arrow 50) can subsequently be made. This results in the signature 20 having a plurality of layers 44 each having a page 28 printed thereon in proper sequence and orientation. In addition, as best shown in FIG. 6, the resulting signature 20 is provided with a closed backbone 51 which results in a stable signature 20 suitable for handling by a conventional high speed rotary gathering machine. Such a high-speed rotary gathering machine (not shown) can be used to extract a single signature 20 from a stack of produced signatures 20 and place it onto a gathering belt or other suitable mechanism for subsequent operations.

Such subsequent operations may include a shearing process wherein edges 52, 54, 56, and 58 (FIG. 5) are sheared to separate each of the layers 44 into individual sheets. Another subsequent operation would be to take the individual sheared sheets and combine them into a bound publication. Alternatively, multiple signatures could be sheared and then bound together into a larger volume or publication.

Rather than forming individual signatures 20 which can be readily handled by rotary gathering and binding machines, the log 46 can be individually handled. More specifically, the web 24 can be fan folded many times to form a relatively large log 46 comprised of numerous signatures 20. The log 46 can then be transported to a separate cutting and folding apparatus wherein a section of the log 46, comprised of a smaller number of fan folds can be cut and then chop folded to form the signature 20. For example, the log 46 can be formed from sixty fan folds wherein the desired signature 20 is to be formed from only six fan folds. In such an example, the log 46 would contain ten signatures 20. The log 46 can then be segmented into ten smaller bundles, each comprised of six fan folds, with each bundle then being chop folded into one of the signatures 20. Optically readable marks or bar codes could be provided as an indication as to where each smaller bundle begins and ends.

Figure 7:
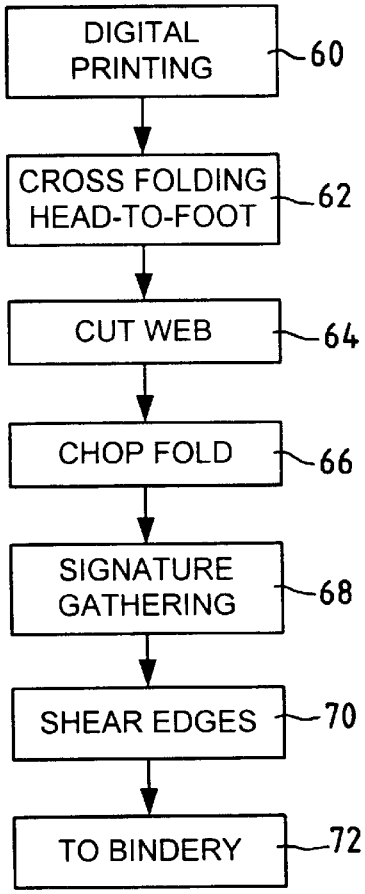
FIG. 7 is a flow chart depicting steps of a method of forming signatures according to the teachings of the present invention.

Referring now to FIG. 7, one embodiment of the operation or method by which the signature 20 is formed is illustrated in flow chart form. Starting with step 60, the pages 28 are digitally printed onto the moving web 24. As shown in step 62, the moving web 24 is then fan folded or cross folded in a head to foot alternating fashion to create fan folds 34. Once the fan folds 34 are created, the web 24 is severed as indicated by step 64 to form the log 46. The log 46 can then be chop folded as indicated by step 66 zero, one or more times to form the signature 20. The signature 20 is then gathered as indicated by step 68 by a high-speed rotary gathering machine and delivered to a shearing operation wherein the edges 52, 54, 56, and 58 are severed as indicated by step 70. The individual sheets resulting from step 70 are then delivered to a bindery which binds the pages together either alone or in combination with other signatures as indicated by step 72.

From the foregoing, it can be seen that the invention provides a method for folding demand printed webs into signatures for gathering by rotary gathering and binding machines. The resulting signature is of a sturdy and stable construction which enables conventional high-speed rotary gathering machines to extract a single signature from a stack for subsequent binding operations.

What is claimed is:

1. A method of producing a signature, comprising the steps of:

printing pages onto a moving web, the web moving along a longitudinal axis;

creating multiple fan folds across the web, each fan fold being made across a transverse axis of the web, the transverse axis being orthogonal to the longitudinal axis;

cutting the web after a desired number of fan folds have been created, the cutting step resulting in a log having a zig-zag configuration in cross-section; and creating at least one chop fold in the log, each chop fold being made along the longitudinal axis of the web.

2. The method of claim 1, wherein the printing step is performed on-demand via a digital printer.

3. The method of claim 1, further including the step of gathering the signature using a high-speed gathering machine.

4. The method of claim 3, further including the step of shearing edges of the signature to form multiple individual pages.

5. The method of claim 4, further including the step of binding multiple sheared signatures together.

6. The method of claim 1, wherein the printing step results in a plurality of pages printed on the web, and further including the steps of orienting the pages on the web so as to be properly aligned within the resulting signature.

7. The method of claim 1, wherein the step of creating multiple fan folds alternates between head folds and foot folds.

8. The method of claim 1, wherein the printing step includes the step of printing at least two versions of the signature for marketing test purposes.

9. The method of claim 1, wherein the printing step includes the step of printing a different subscriber address on each signature.

10. A method of producing a bound publication, comprising the steps of:

traversing a web of printable material along a longitudinal axis;

printing pages onto the moving web;

fan folding the web transverse to the longitudinal axis;

cutting the web transverse to the longitudinal axis, resulting in a separated log;

chop folding the log along the longitudinal axis to form a signature;

shearing edges of the signature to create individual pages; and binding the individual pages together.

11. The method of claim 10, wherein the printing step is performed using a print-on-demand device.

12. The method of claim 11, wherein the print-on-demand device is an ink jet printer.

13. The method of claim 11, wherein the print-on-demand device is a laser printer.

14. The method of claim 10, wherein the printing step creates individual pages of text and graphics oriented on the web so as to be properly aligned when the web is folded.

15. The method of claim 10, wherein the fan folding step is performed multiple times, each folding step resulting in alternating head and foot folds.

16. The method of claim 10, wherein the traversing, printing, fan folding, cutting, chop folding, and shearing steps are performed multiple times to result in multiple signatures, and wherein the binding step involves binding multiple signatures together.

17. The method of claim 10, wherein the printing step includes the step of printing at least two versions of the signature for marketing test purposes.

18. The method of claim 10, wherein the printing step includes the step of printing a different subscriber address on each signature.

19. A signature formed from a moving web of material, the web having pages printed thereon by a print-on-demand device, the signature being adapted to be gathered and bound by a rotary gathering and binding machine, the signature comprising:

a continuous sheet of printable material cut from the web, the sheet having multiple layers, each layer having pages printed thereon, the sheet having a longitudinal axis and a transverse axis;

at least one fold in the continuous sheet along the transverse axis;

at least one fold in the continuous sheet along the longitudinal axis, the fold along the longitudinal axis creating a fold in the fold made along the transverse axis; and a closed backbone along a first edge, the closed backbone being formed by the fold along the longitudinal axis.

20. The signature of claim 19, further including multiple folds along the transverse axis, the multiple transverse folds alternating between a foot fold and a head fold.

21. The signature of claim 19, wherein the pages are printed side by side on the web.

22. The signature of claim 19, wherein the print-on-demand device is a laser-printer.

23. The signature of claim 19, wherein the print-on-demand device is an ink-jet printer.

24. A method of producing a signature, comprising the steps of:

printing pages onto a moving web, the web moving along a longitudinal axis;

creating multiple fan folds across the web, each fan fold being made across a transverse axis of the web, the transverse axis being orthogonal to the longitudinal axis;

cutting the web after a desired number of fan folds have been created, the cutting step resulting in a log having a zig-zag configuration in cross-section;

creating at least one chop fold in the log, each chop fold being made along the longitudinal axis of the web; and the resulting signature including a closed backbone.

25. A method of producing a signature, comprising the steps of:

printing pages onto a moving web, the web moving along a longitudinal axis;

creating multiple fan folds across the web, each fan fold being made across a transverse axis of the web, the transverse axis being orthogonal to the longitudinal axis;

cutting the web after a desired number of fan folds have been created, the cutting step resulting in a log having a zig-zag configuration in cross-section;

creating at least one chop fold in the log, each chop fold being made along the longitudinal axis of the web; and separating the log into smaller bundles prior to the step of creating at least one chop fold.

26. A method of producing a bound publication, comprising the steps of:

traversing a web of printable material along a longitudinal axis;

printing pages onto the moving web;

fan folding the web transverse to the longitudinal axis;

cutting the web transverse to the longitudinal axis, resulting in a separated log;

chop folding the log along the longitudinal axis to form a signature;

shearing edges of the signature to create individual pages;

binding the individual pages together; and performing the chop folding step multiple times resulting in a signature having a closed backbone.

27. A method of producing a bound publication, comprising the steps of:

traversing a web of printable material along a longitudinal axis;

printing pages onto the moving web;

fan folding the web transverse to the longitudinal axis;

cutting the web transverse to the longitudinal axis, resulting in a separated log;

chop folding the log along the longitudinal axis to form a signature;

shearing edges of the signature to create individual pages;

binding the individual pages together; and separating the log into smaller bundles prior to the chop folding step.

* * * * *